United States Patent [19]

Slagley et al.

[11] Patent Number: 4,836,155

[45] Date of Patent: Jun. 6, 1989

[54] VARIABLE DURATION VALVE OPENING MECHANISM

[76] Inventors: Michael W. Slagley; M. Kathy W. Slagley, both of 11661 Flamingo Dr., Garden Grove, Calif. 92641

[21] Appl. No.: 141,947

[22] Filed: Jan. 11, 1988

[51] Int. Cl.[4] ..... F01L 1/20

[52] U.S. Cl. ..... 123/90.16; 123/90.48

[58] Field of Search ..... 123/90.16, 90.5, 90.48, 123/90.39

[56] References Cited

U.S. PATENT DOCUMENTS

| | | | |
|---|---|---|---|
| 934,762 | 9/1909 | Saurer | 123/90.16 |
| 1,542,354 | 6/1925 | Atsumi | 123/90.16 |
| 2,851,851 | 9/1958 | Smith | 123/90.16 |
| 4,205,634 | 6/1980 | Tourtelot, Jr. | 123/90.16 |
| 4,469,056 | 9/1984 | Tourtelot, Jr. et al. | 123/90.16 |
| 4,572,118 | 2/1986 | Baguéna | 123/90.16 |

FOREIGN PATENT DOCUMENTS

| | | | |
|---|---|---|---|
| 544256 | 9/1922 | France | 123/90.48 |
| 262306 | 1/1929 | Italy | 123/90.16 |

*Primary Examiner*—Andrew M. Dolinar

*Attorney, Agent, or Firm*—Allen A. Dicke, Jr.

[57] ABSTRACT

In an internal combustion engine having a cam on a cam shaft and a valve operated thereby, valve opening duration is decreased or increased and valve opening is performed earlier or later by shifting the lifter relative to the line of cam action so that it is acted on earlier or later by the cam.

4 Claims, 1 Drawing Sheet

VARIABLE DURATION VALVE OPENING MECHANISM

CROSS REFERENCE

This application is related to patent application Ser. No. 231,123, filed Feb. 3, 1981, now abandoned; to patent application Ser. No. 362,953, filed Feb. 29, 1982, now abandoned; to patent application Ser. No. 606,375, filed Mar. 8, 1984, now abandoned; and to patent application Ser. No. 801,473, filed Nov. 25, 1985, now Pat. No. 4,723,516. The disclosures of these applications are incorporated herein by this reference.

TECHNICAL FIELD

This invention is directed to a valve variable duration control for the valves in an internal combustion engine to improve combustion efficiency and reduce contaminants exhausted from the engine.

BACKGROUND

In the normal four-cycle internal combustion engine, a camshaft is driven at half the crankshaft rotational speed. Cams on the camshaft control the opening and closing of both the intake and exhaust valves. In the operation of a four-cycle internal combustion engine, if the cam timing and duration is such that the intake valve begins opening at top dead center of the intake stroke and is closed at the bottom center of the stroke and the exhaust valve begins opening at the bottom center of the exhaust stroke, the engine would be restricted to low rpm operation and low power output. At high rotative speed (rpm), the breathing efficiency would be low. On the other hand, if the cam timing and duration allowed sufficient overlap of valve opening and closing at the beginning and end of both the intake and exhaust strokes, breathing efficiency would be greatly increased at higher rotative speed, although at very low rotative speed, efficiency would be impaired, economy reduced, and pollution increased.

No equally simple and efficient mechanism exists which permits adjustment of the cam timing to control the duration of valve opening during engine operation. Such valve adjustment is necessary for optimizing engine function with varying conditions. The principal change in engine operating conditions, for which valve open duration is advantageous, is change in rotative speed, although other engine operating criteria such as load, fuel quality, air temperature and pressure and the like have a small effect on engine operating conditions and can be employed as signals for valve open duration adjustment.

SUMMARY

In order to aid in the understanding of ths invention, it can be stated in essentially summary form that it is directed to a variable duration valve opening mechanism in an internal combustion engine, or like, wherein a valve is opened by means of a rotating cam on a camshaft. A valve lifter is engaged by the cam and operates a valve. Adjustment is achieved by laterally shifting the lifter so that it is generally acted upon by the cam earlier, in the case of an exhaust valve, for earlier valve opening. A rocker arm can be employed between the lifter and the valve to obtain increased, decreased, or maintain constant valve opening even with shorter lifter motion.

It is thus an object and advantage of this invention to provide a variable duration valve opening mechanism to permit changing of the valve opening relationship in an internal combustion engine with a simple and reliable mechanism.

It is another object and advantage of this invention to provide a mechanism whereby the opening point of a selected valve can be made proportionally earlier and the closing point of a selected valve can be made later during the cycle of an internal combustion engine, with a simple and reliable mechanism.

It is a further object and advantage of this invention to control the valve open duration by selecting the point on the rising and falling cam lobe which will be effective to move the lifter to actuate the valve so that the entire cam lift is not always used.

Other objects and advantages of this invention will become apparent from a study of the following portion of the specification, the claims and the attached drawings.

DESCRIPTION OF THE PREFERRED EMBODIMENT

Figure 1:
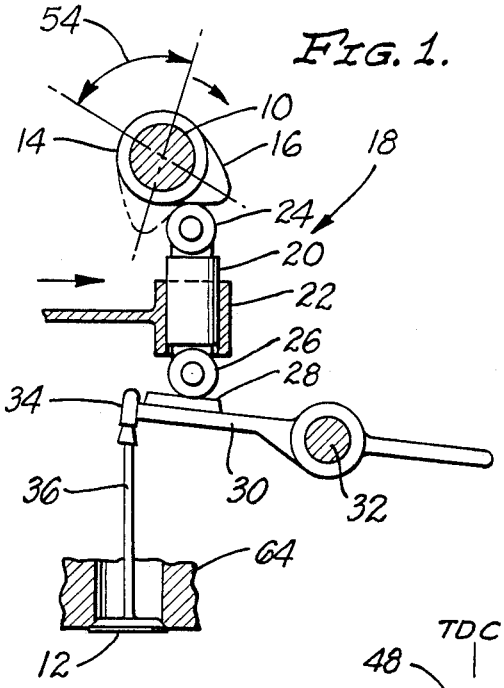
FIG. 1 is a side-elevational view of a schematic valve opening mechanism shown at the opening point for short duration of a valve.

FIGS. 1, 2, 3 and 4 each show different positions of the same mechanism of an internal combustion engine. The internal combustion engine has a cylinder with a piston moving therein to increase and decrease the volume of the cylinder. The piston carries a connecting rod which is actuated by a crank on a crankshaft. The crankshaft drives camshaft 10 at a rotative speed of half that of the crankshaft for a four-cycle engine. In the particular illustration, valve 12 is an intake valve and the camshaft rotates in the clockwise direction. Should the valve 12 be an exhaust valve for which earlier opening would be desirable, the camshaft 10 could rotate in the counter-clockwise direction. Camshaft 10 has a cam 14 thereon which has a lobe 16. In FIG. 1, the valve control mechanism 18 is set so that the valve 12 begins opening at top dead center, which is point 38 in FIG. 5, to permit air or air plus fuel to be inducted into the cylinder.

Valve lifter 20 slides in lifter guide 22. Lifter 20 carries cam follower roller 24 on its upper end for contact by the cam lobe 16 to thrust the lifter downward. The lower end of lifter 22 may also carry a roller 26 which contacts bearing plate 28 on rocker ar 30. Rocker arm 30 rotates on rocker arm shaft 32. The end of rocker arm 30 carries hydraulic damper-lash adjuster 34 thereon. The damper-adjuster 34 thrusts on the stem 36 to open valve 12. A conventional spring urges the valve towards the closed position, and the valve mechanism acts against this spring to open the valve.

In some operating positions, the valve mechanism has lash in it. In order to prevent the lash from damaging the mechanical components, hydraulic damper 34 permits the lash to operate but cushions the shock when the lash decreases to zero by action of the various parts. For this purpose, lash is defined as lost motion in the mechanism where one part may be moving while another part is not moving because there is no rigid connection therebetween. The function of the lash in the system will be described in more detail below. Damper 34 may be supplied with oil from an oil passage in rocker arm 30 and rocker shaft 32.

In FIG. 1, the lifter guide 22 is shown as holding the lifter 20 to the right of the radial line of action of the cam lobe 16, in this case radially downward. Cam lobe 16 is shown at the beginning of the opening stroke which, in this example, is at the top dead center point 38 shown in FIG. 5. As the cam 14 rotates, the cam lobe 16 moves to the maximum lift position, shown in FIG. 2 and as shown at point 40 in FIG. 5, which is halfway between the opening and closing position for the symmetric cam lobe shape shown in this example. The dashed line position 42 of the cam lobe 16 shown in FIG. 1 is the point at which the valve closes, which is the bottom center point 44. The intake valve 12 has thus been open through the 90° angle indicated at 46 in FIG. 1.

Figure 2:
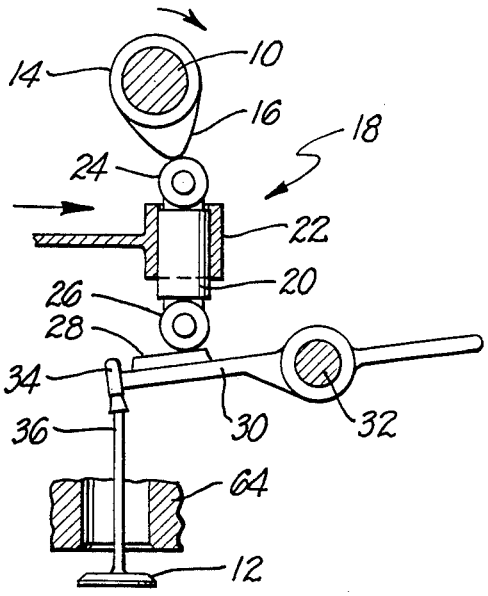
FIG. 2 is a similar view showing the maximum lift point of the valve during short duration.

Lifter guide 22 is in its rightmost position in FIGS. 1 and 2 wherein the valve 12 opens at top dead center, closes at bottom dead center, and is thus opened for 180° in the crankshaft or 90° on the camshaft. Lifter guide 22 is movable from the rightmost position in FIGS. 1 and 2 to a leftmost position in FIGS. 3 and 4 wherein the intake valve 12 opens earlier and closes later on the crankshaft timing cycle. In FIGS. 1, 2, 3 and 4, the extreme positions of the lifter guide 22 are exemplary and represents a distance which is sufficiently visible to illustrate in the drawings. A lesser or greater amount may be used in actual practice. The lateral motion of the valve lifter 20 from the leftmost position in FIG. 3 to the rightmost position in FIG. 1 has several effects. For one thing, it moves the contact point of roller 26 on bearing plate 28 closer to the rocker arm shaft 32. This increases the mechanical advantage so that, if the valve lifter 20 moves through the same stroke, the valve 12 opens to a greater extent. However, moving the valve lifter to the right position in FIG. 1 also moves cam follower roller 24 away from the center of camshaft 10 so that the cam follower roller 24 is not engaged by the cam lobe 16 until higher up on the lobe. In other words, there is lost motion between the low, circular part of the cam and the first contact point of the lobe 16 on cam follower roller 24. This causes the valve lifter 24 to have less stroke between the first contact point and the peak of the lobe, which is the position shown in FIG. 2. When the two effects are equally weighted, valve 12 opens to the same extent. In other words, a lesser stroke by the valve lifter 20 caused by moving it to the right so as to create lost motion between the cam follower roller and the cam lobe causes less stroke of the valve lifter 20, but the same motion to the right also increases the mechanical advantage of rocker arm 30 so that the lift of valve 12 remains the same. This effect is seen by comparing FIGS. 2 and 4. By changing the shape of the rocker arm the valve lift could be increased or decreased, but in many instances always opening the valve to the maximum amount possible without causing an impact between the valve and the piston may be preferable.

Figure 5:
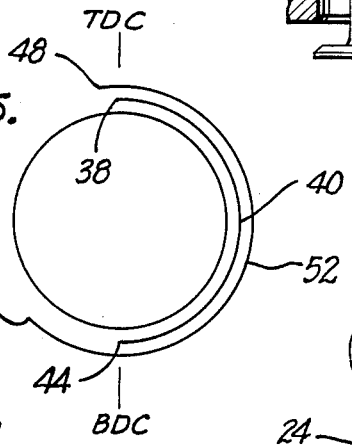
FIG. 5 is a timing diagram showing possible opening and closing points of the valve on the crank timing circle.
Figure 3:
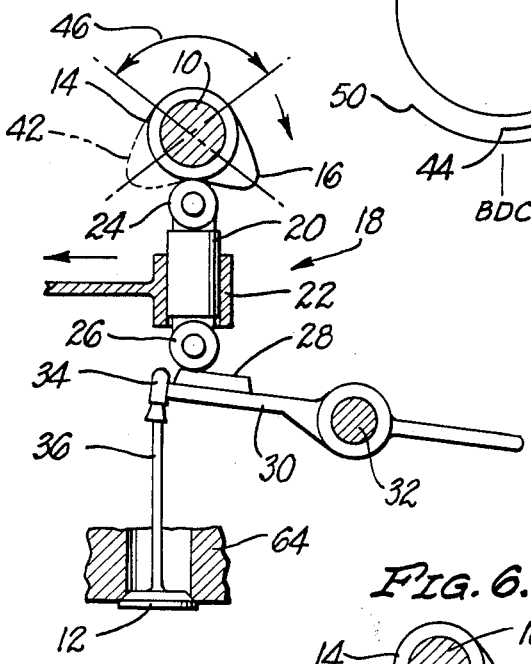
FIG. 3 is a similar view showing long duration center opening of a valve.
Figure 4:
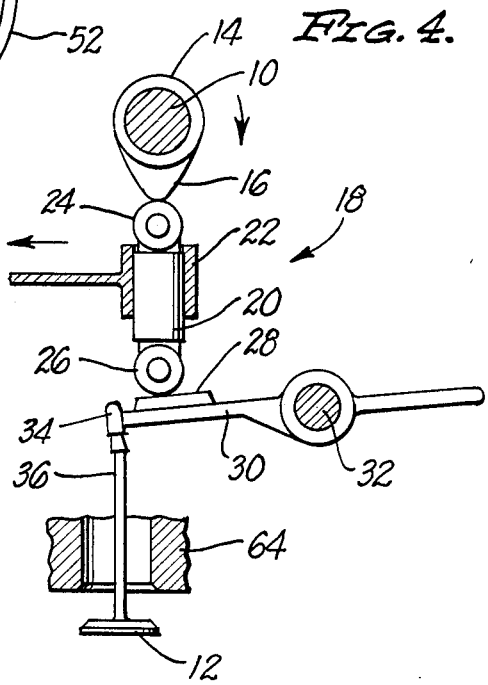
FIG. 4 is a similar view to FIG. 3 showing the maximum opening point of the valve during long duration.

There is another effect which results from laterally shifting valve lifter 20 to the left, from the position of FIG. 1 to the position of FIG. 3. This effect is that valve opening starts sooner and ends later, as represented by points 48 and 50 shown in the timing diagram of FIG. 5, where the inner partial circle represents the shifted position of FIGS. 1 and 2, and the outer partial circle represents positions of FIGS. 3 and 4. The maximum lift point 52 is also earlier, as indicated in FIGS. 4 and 5.

The hydraulic damper-lash adjuster 34 can be a hydraulic device resembling a hydraulic lifter, except that the system should be valved so that it becomes hard at a certain lift point, regardless of lash. The lash would be taken up by a damper mechanism which takes the shock out of the system, but compresses rather than lifts the valve, until the hard height is achieved.

Figure 6:
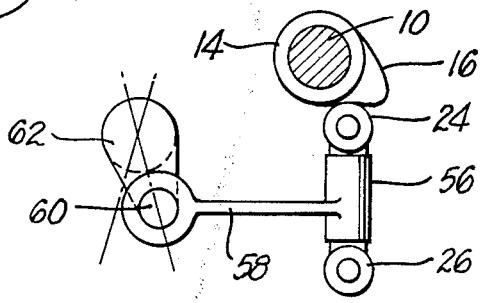
FIG. 6 is a schematic view of another valve lifter mechanism usable in the structures of FIGS. 1 through 4.

The lifter guide 22 moves from one position to the other by sliding. Other methods of controlling the lateral lifter position could be employed. For example, FIG. 6 shows lifter 56 mounted on arm 58. Lifter 56 carries thereon the same cam follower roller 24 and roller 26 for engagement on the rocker arm 30. Cam follower roller 24 is actuated by lobe 16 on cam 14, which is fixed to camshaft 10. Arm 58 is pivoted on crank pin 60, which is eccentrically mounted on crank 62. Crank 62 is pivotally mounted on the main structure, such as engine block 64, see FIGS. 1 and 3. Rotation of crank 62 moves crank pin 60 from left to right to move the lifter 56 from left to right. The lifter moves up and down under the actuation of lobe 16 and drives the rocker arm. The only difference is that, during camshaft rotation, lifter 56 rotates around the center of crank pin 60 rather than moving linearly up and down. Of course, this difference of motion can be accommodated in the detailed design. In this embodiment of the application, lifter 56 could also perform some damping properties. A source of oil to provide damping could be obtained from an oil passage in arm 58.

The amount of motion and the direction of motion effective in opening the valve is that motion which is resolved in the direction of valve opening. Since the valve is mounted on conventional valve guides, the valve 12 is a sliding valve axially of its stem in the up-and-down direction in FIGS. 1, 2, 3 and 4. It is the motion in that direction which is important, and thus it is the motion in that direction, or parallel to it by the cam follower roller which causes valve opening. Of course, the intermediate rocker arm has the effect of distance multiplication, and this must be added as a factor for valve opening height. Thus, when the cam follower roller is moved to a lateral position, that is lateral with respect to the direction of motion of the sliding valve, it may be acted upon earlier or later by the cam lobe 16.

As described above, the structure is configured to hold open the intake valve later in the rotational cycle. In those cases where it is desired to maintain the exhaust valve open proportionally earlier in the rotational cycle, such can be accomplished by the present mechanism, by using a choice of several alternative embodiments. One embodiment is the cam could rotate the opposite direction. Another embodiment is a separate rocker arm can be employed on the opposite side of the cam shaft center. When the lifter position is moved closer to the rocker arm pivot point the change in phase would be in the opposite direction illustrated. Another embodiment would involve having the lifter operate on the underside of the rocker arms. The opposite arms of the rocker arm could be bent so that the lifter would contact an intake rocker arm on the left side and an exhaust rocker arm on the right side, with both rocker arms being mounted on the same rocker arm shaft. Whenever a rocker arm shaft is mentioned, however, alternative embodiments of mounting rocker arms, such as on stud, would also work. Another similar embodiment using only one rocker arm shaft for both the exhaust and intake valve rocker arms, may be accomplished by mounting the intake rocker arms so that they are contacted by lifters below the camshaft and to mount exhaust rocker arms so that they are contacted by lifters above the camshaft. Such could be reversed. In such a case, the rocker arms could be manufactured with a curve in them so that the curved portion of the rocker arm extend above or below the camshaft, depending upon whether or not the rocker arm was for actuation of an exhaust or an intake valve. In this way, control of valve opening timing in the internal combustion engine cycle and concurrent control of valve open duration is achieved. The structure can be used either for intake or exhaust valves, and the relationship between timing and duration can be controlled by design of the structure.

A controlling factor in the valve open duration is the amount of vlalve lash established at any specific position of the valve lifter. This is primarily controlled by the shape of the surface in contact with the lifter, but may also be controlled by adjusting the amount of fluid in a lifter.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A variable duration valve opening mechanism comprising:

a camshaft, a cam on said camshaft, said cam having a lobe;

a valve movable from a closed position to an open position along a path;

a valve lifter engaged by said cam lobe, said valve lifter being movable by said cam lobe in a direction having a component of direction along said path, said valve lifter being connected to said valve so that motion of said lifter opens said valve;

a rocker arm pivotally carried on a rocker arm shaft, said rocker arm having a contact point engaging with said valve to open said valve and said rocker arm being engaged by said valve lifter so that said valve lifter engages on said rocker arm and said rocker arm engages on said valve to move said valve along its path, said rocker arm engaging only on its pivot, said valve and said valve lifter; and means for moving said valve lifter comprising a valve lifter guide which slidably receives said valve lifter, said valve lifter guide being movably mounted with respect to said camshaft for moving said valve lifter in a direction laterally of said path so as to be acted upon by said lobe at a different rotative position of said camshaft and for moving the contact point of said valve lifter onto said rocker arm to control the point of opening and closing of said valve with respect to camshaft rotation.

2. A variable duration valve opening mechanism comprising:

a valve movable along a path from a closed position to an open position;

a rotable camshaft, a single cam fixed on said camshaft for actuation of said valve, a lobe on said cam;

a valve lifter, a cam follower on said valve lifter, said cam follower being a roller, said cam follower being positionable for contact by said cam;

a rocker arm, said rocker arm being pivotally mounted on a rocker arm shaft, said rocker arm contacting said valve to open said valve along its path, said valve lifter carrying a roller in contact with said rocker arm, said rocker arm being only in contact with said rocker arm shaft, said valve and said valve lifter so that upon rotation of said camshaft said cam lobe moves said valve lifter, said valve lifter moves said rocker arm and said rocker arm opens said valve; and means for moving said valve lifter laterally with respect to said path, said means for moving said valve lifter also including means for moving the contact point of said roller on said valve lifter with said rocker arm to control the amount of valve opening by controlling the mechanical advantage of said rocker arm so that at different lateral positions of said valve lifter, said cam lobe engages said cam follower at different rotative positions of said camshaft so that lateral positioning of said cam follower with respect to said path controls the angular point at which rotation of said camshaft begins opening said valve.

3. The mechanism of claim 2 wherein said means for moving said valve lifter comprises a lifter guide in which said valve lifter is slidable.

4. The mechanism of claim 2 wherein said valve lifter is mounted on an arm and said arm is pivotally mounted on a crank pin, said crank pin being carried by a crank which is pivotally mounted with respect to said mechanism so that rotation of said crank controls the location of said pin and controls the lateral position of said valve lifter with respect to said camshaft.

* * * * *